US008474530B2

(12) United States Patent
Rogers et al.

(10) Patent No.: US 8,474,530 B2
(45) Date of Patent: Jul. 2, 2013

(54) METHOD AND APPARATUS FOR A HIGH SIDE ORIENTING SUB FOR MULTI-LATERAL INSTALLATIONS

(75) Inventors: Henry E. Rogers, Duncan, OK (US); David Szarka, Duncan, OK (US); Robert Pipkin, Marlow, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 387 days.

(21) Appl. No.: 12/903,741

(22) Filed: Oct. 13, 2010

(65) Prior Publication Data

US 2012/0090856 A1 Apr. 19, 2012

(51) Int. Cl.
*E21B 47/024* (2006.01)

(52) U.S. Cl.
USPC ..... 166/255.2; 166/255.1; 166/113; 175/45

(58) Field of Classification Search
USPC ..... 166/66, 113, 117.5, 255.1, 255.2; 175/45
See application file for complete search history.

(56) References Cited

U.S. PATENT DOCUMENTS

| | | | | |
|---|---|---|---|---|
| 2,142,559 | A | | 1/1939 | Duus |
| 2,691,507 | A | | 10/1954 | Brown |
| 3,313,360 | A | | 4/1967 | Frisby |
| 3,746,106 | A | * | 7/1973 | McCullough et al. ..... 340/853.5 |
| 5,829,526 | A | | 11/1998 | Rogers et al. |
| 6,843,318 | B2 | | 1/2005 | Yarbro |
| 2009/0199419 | A1 | | 8/2009 | Hepburn |

FOREIGN PATENT DOCUMENTS

| | | |
|---|---|---|
| EP | 2 088 282 A2 | 8/2009 |
| EP | 2 088 282 A3 | 9/2011 |
| GB | 2 417 269 A | 2/2006 |

OTHER PUBLICATIONS

International Search Report and Written Opinion of the International Searching Authority dated Mar. 23, 2012, in corresponding PCT Application PCT/GB2011/001461.

* cited by examiner

*Primary Examiner* — William P Neuder
*Assistant Examiner* — Richard Alker
(74) *Attorney, Agent, or Firm* — John W. Wustenberg; McAfee & Taft

(57) ABSTRACT

An apparatus for indicating the orientation of a structure which includes an orienting sub releasably connected at an outer case. The orienting sub is at a preselected orientation relative to the structure. A change in fluid pressure of a predetermined magnitude of flow rate through the orienting sub will indicate that the structure is at a desired orientation in the well.

22 Claims, 7 Drawing Sheets

METHOD AND APPARATUS FOR A HIGH SIDE ORIENTING SUB FOR MULTI-LATERAL INSTALLATIONS

BACKGROUND

The present disclosure relates generally to equipment utilized and operations performed in conjunction with a subterranean well and, in an embodiment described herein, more particularly provides casing or work string orientation indicating apparatus and methods.

In order to allow accurate azimuthal orientation of a structure (such as a pre-milled casing window, orienting latch profile, production assembly, etc.) in a wellbore, prior orienting systems have typically relied on use of MWD tools or other pressure pulsing orientation indicating devices. Unfortunately, at increased depths, such pressure pulses are increasingly attenuated when the return flow path is restricted (such as, in an annulus between an inner work string and an outer casing or liner string), and pressure "noise" is introduced due to varied restrictions to flow in the return flow path. These conditions make pressure pulses and data transmitted by pressure pulses difficult to detect and interpret at the surface.

Furthermore, typical MWD tools cannot be cemented through, are too valuable to be drilled through, and do not provide for passage of plugs therethrough for releasing running tools, setting hangers and packers, etc. If an MWD tool must be separately conveyed and retrieved from a well, additional time and expense are required for these operations. In addition, conveyance of MWD tools into very deviated or horizontal wellbores by wireline or pumping the tools down presents additional technical difficulties.

Therefore, it may be seen that improvements are needed in the art of indicating orientation of structures in a wellbore.

SUMMARY

An apparatus for indicating the orientation of a structure in a deviated wellbore comprises an orienting sub releasably connected in an outer case. The orienting sub has a preselected or predetermined orientation relative to the structure. A change in fluid pressure at a selected flow rate through the orienting sub will indicate the structure is the desired orientation of the well. The orienting sub is releasably connected so that when the structure is at its desired orientation, the orienting sub may be released from the outer case to which it is connected. The orienting sub includes a collet and an orienting device connected to the collet and rotatable therewith. The orienting device is positioned at a predetermined orientation with respect to the structure. Thus, the change in pressure indicating that the orienting device is at a particular location is an indication that the structure is at the desired orientation.

The method of orienting the structure may comprise positioning an orientation device at a predetermined position relative to the structure and connecting the orienting device in the pipe string at the predetermined position. The method may further include lowering the pipe string into a deviated well and flowing fluid therethrough at a selected flow rate and observing a pressure reading resulting from the flow. The flow is then stopped and the pipe is rotated in the well and flow is restarted. A pressure reading is taken. The process is repeated until the change in pressure, in this case a pressure increase, is noted which will indicate that the structure is in its desired orientation.

BRIEF DESCRIPTION OF THE DRAWINGS

FIG. 6 shows the orienting sub after it has been released from its outer case.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the following description of the representative embodiments of the disclosure, directional terms, such as "above," "below," "upper," "lower," etc., are used for convenience in referring to the accompanying drawings. In general, "above," "upper," "upward" and similar terms refer to a direction toward the earth's surface relative to a wellbore, and "below," "lower," "downward" and similar terms refer to a direction away from the earth's surface relative to the wellbore.

Figure 1:
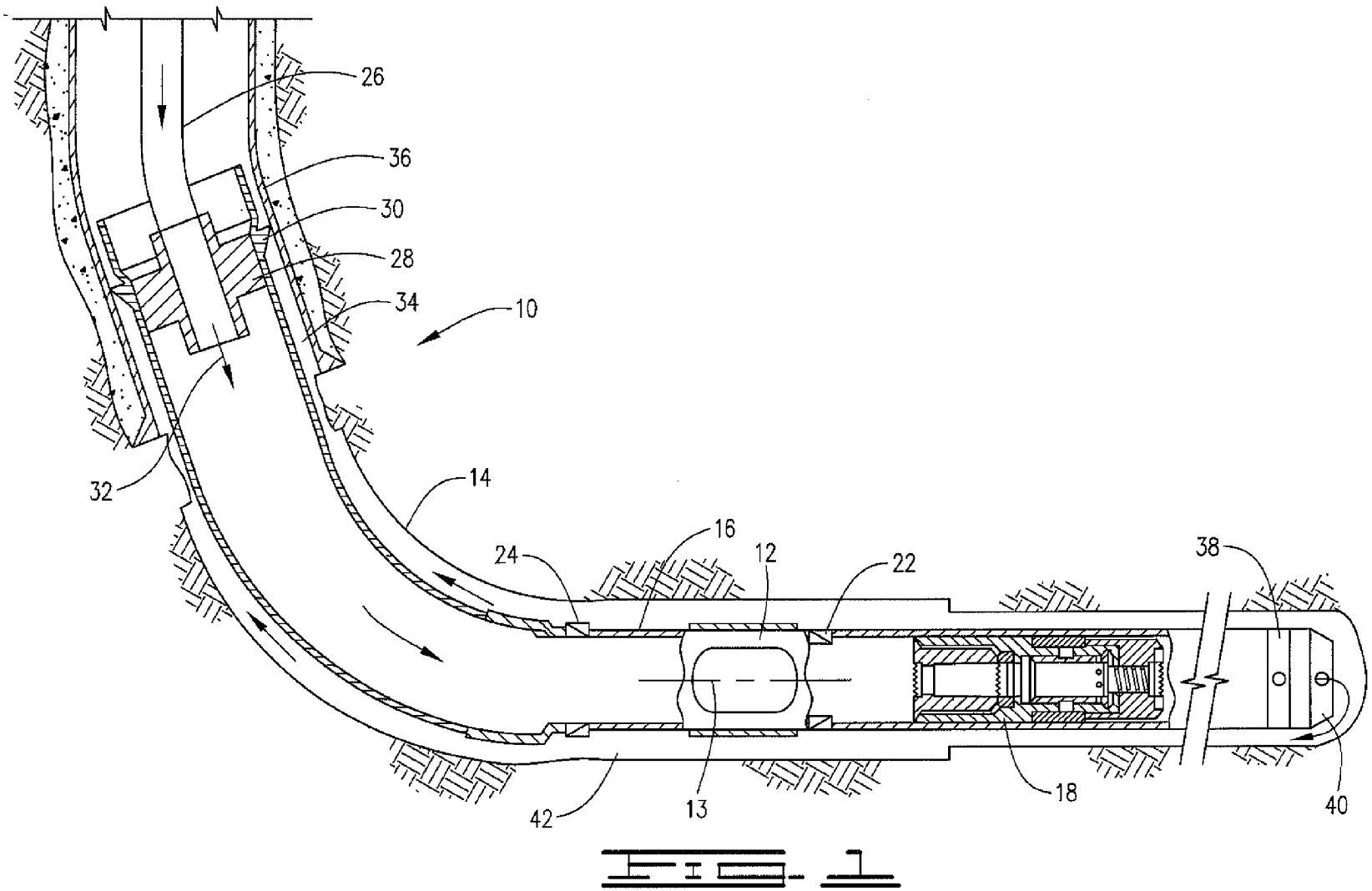
FIG. 1 schematically shows a casing with an orienting sub lowered into a well.

Representatively illustrated in FIG. 1 is a system 10 and associated method for indicating orientation of a structure 12 in a deviated subterranean wellbore 14, which system and method embody principles of the present disclosure. In the disclosed embodiment, the structure 12 is a window for use in drilling a branch wellbore to intersect the wellbore 14, but orientation of other types of structures may be achieved in keeping with the principles of the present disclosure. Window 12 has a central axis 13.

In the system 10, it is desired to azimuthally orient the window 12 relative to the wellbore 14. As depicted in FIG. 1, the wellbore 14 is substantially horizontal, but the wellbore could be otherwise deviated from vertical.

The desired orientation of the window 12 in this example is vertically upward relative to the wellbore 14. The window 12 is interconnected in a tubular string or pipe 16 (such as a liner string). Tubular string 16 is to be rotated within the wellbore 14 until it is oriented so that the window faces vertically upward. In the described embodiment, tubular string 16 is a casing to be cemented into wellbore 14.

It should be understood that orientations of structures other than upward can also be accomplished in keeping with the principles of the present disclosure. For example, the window 12 could be oriented vertically downwardly or any other direction, if desired, by merely adjusting an alignment between the window 12 and an orientation or orienting sub 18, which is also interconnected as part of the pipe string 16. In the example of FIG. 1, the alignment between orienting sub 18 and window 12 is accomplished prior to conveying tubular string 16 into wellbore 14.

Structures other than the window 12 may additionally, or alternatively, be oriented relative to the wellbore 14 by use of the orientation or orienting sub 18. For example, another structure 22 to be oriented could be a latch profile of the type used to anchor and orient subsequently installed milling and drilling whipstocks and deflectors.

Yet another structure 24 to be oriented could be an alignment tool used to orient and position subsequently installed completion equipment relative to the window 12, wellbore 14 and/or tubular string 16.

As depicted in FIG. 1, a tubular work string 26 is being used to convey the casing 16 into the wellbore 14. At a lower end of the work string 26 is a setting tool 28 used to set a hanger 30 at an upper end of the tubular string 16.

Prior to sealing off an annulus 34 between the hanger 30 and a previously cemented casing or liner string 36 extending toward the surface, fluid 32 can be circulated through the work string 26, through casing 16, through a cementing float valve 38 and casing shoe 40 at a lower end of the tubular string 16, into an annulus 42 between the casing 16 and the wellbore 14, and via the annulus 34 to the surface.

A relative pressure differential across orienting sub 18 while fluid 32 is being circulated through the casing 16 can be observed at a remote location, such as the earth's surface or other surface drill site location. For example, one or more pressure gauges (not shown) may be used to monitor pressure applied to the work string 26 and pressure in the casing string 36.

In a method of using the device 18, a change in the pressure differential across the device at a certain rate of flow of the fluid 32 is observed as an indication that a desired orientation of the structure 12, 22 and/or 24 has been achieved. In the described embodiment an increase in pressure will reflect that orienting sub 18 is properly oriented, thus indicating that structure 12 is properly oriented. Work string 26 can be used to rotate casing 16 in the wellbore 14 until the increased pressure differential is observed, at which point the rotation may be ceased, or further rotation may be used if desired to achieve a different desired orientation of structure 12 on other structure.

Preferably, fluid 32 is not continuously flowed through the casing 16 while it is rotated. Instead, circulation of fluid 32 is ceased while the casing 16 is rotated. After rotating casing 16 an incremental amount, circulation of fluid 32 at the same flow rate is restarted and the differential pressure across orienting sub 18 is observed to see if the desired orientation has been achieved. If not, then the process of ceasing circulation, rotating casing 16 and resuming circulation is repeated until the desired orientation has been achieved. The pressure change may be determined simply by measuring surface pump pressure.

It is understood and known in the art that a specified amount of rotation at the surface may result in less rotation at the location of the orienting sub, due to friction and other variables. It may be necessary to wait for a period of time after rotation prior to circulating to ensure the position of the orienting sub. It may also be desirable to circulate, wait and then circulate again one or more times to verify whether orienting sub 18 and thus the structure 12 are at the desired orientation.

Figure 3:
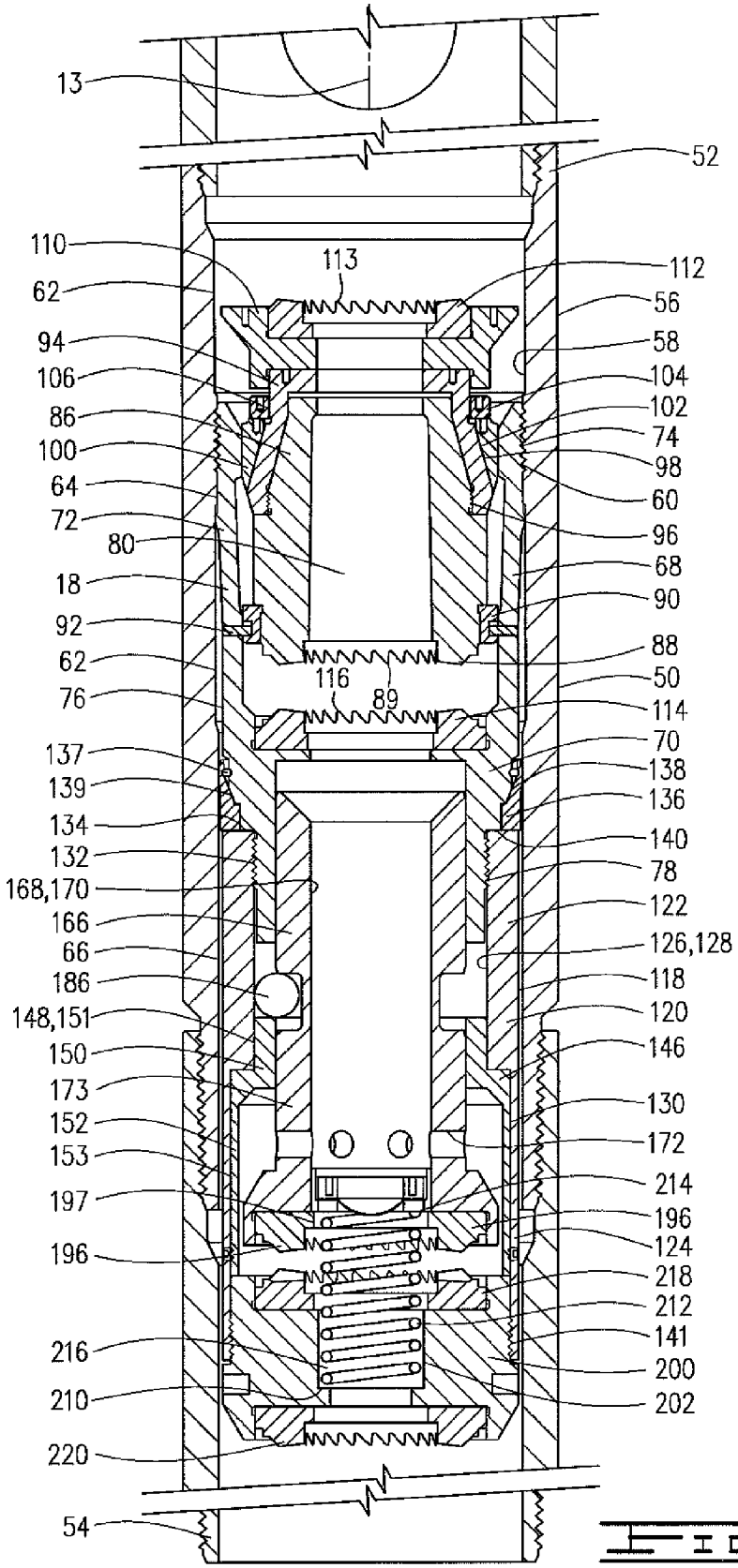
FIG. 3 is a cross-sectional view of the orienting sub disclosed herein.

Referring to FIG. 3 and following, orienting sub 18 is positioned in an outer case 50 which at its upper and lower ends 52 and 54 is adapted to be connected in casing 16 and thus forms a part of casing 16. Outer case 50 has outer surface 56 and has inner surface 58 with a thread profile 60 thereon. Inner surface 58 has first inner diameter 62, second inner diameter 64 on which thread profile 60 is defined and third inner diameter 66. A collet 68 is disposed in outer case 50. Collet 68 comprises a collet body 70 with a plurality of collet fingers 72 extending therefrom. Collet fingers 72 have a thread profile 74 defined on the outer surface 76 thereof. Thread profile 74 will mate with thread profile 60 on outer case 50. Collet body 70 may include a threaded neck or threaded extension 78. Central flow passage 80 is defined through collet 68.

A releasing sleeve 86 is positioned in collet 68. Releasing sleeve 86 has a lower end 88 which may have a non-rotation profile and thus may include teeth 89. A releasing ring 90 is threadedly connected to releasing sleeve 86. Shear pins 92 releasably affix releasing sleeve 86 to collet 68, preferably through collet body 70.

A cap 94 is threadedly connected to releasing sleeve 86 at threaded connection 96. Cap 94 has a sloped or angled outer surface 98 defined thereon. A wedge, which may be referred to as an interference wedge 100 is positioned about cap 94 and has an angled or sloped inner surface 102 that will mate with the sloped outer surface 98 of cap 94. Wedge 100 may be a split ring wedge. A retaining ring 104 is threaded to cap 94 at threaded connection 106. Retaining ring 104 will be threaded onto cap 94 and will urge wedge 100 along cap 94 to create a radially outwardly directed force on collet fingers 72. The outwardly directed radial force will maintain the engagement between the collet fingers 72 and outer case 50.

A plug seat 110 adapted to receive a cementing plug may be threadedly connected to cap 94. Plug seat 110 may include a non-rotating profile and thus may include an anti-rotation ring 112 with teeth 113 defined thereon. Anti-rotation ring 112 may be connected by threading or other means known in the art. An anti-rotation ring 114 with teeth 116 may also be positioned in collet 68 and preferably in collet body 70. As will be explained in more detail hereinbelow, collet 68 is releasably connected to outer case 50 such that it may be displaced through casing 16. The application of a downwardly directed force of a predetermined amount will break shear pins 92 which will allow releasing sleeve 86 to pass downwardly and collet fingers 72 to deflect radially inwardly as the force is applied thus releasing orienting sub 18 from outer case 50.

An orienting device 118 is connected to collet 68 and preferably is threadedly connected thereto. Orienting device 118 has an outer sleeve 120 with first or upper portion 122 and second or lower portion 124. Outer sleeve 120 has inner surface 126 defining a first inner diameter 128 on first portion 122 and a second inner diameter 130 on second or lower portion 124. Second inner diameter 130 is larger than first inner diameter 128. Thus, inner surface 126 is a stepped inner surface 126.

Outer sleeve 120 is connected to collet body 70 at threaded connection 132. Collet body 70 defines a downward facing shoulder 134. Uppermost end 140 of sleeve 120 may abut shoulder 134 when sleeve 120 is connected to collet 68. An elastomeric ring 136 with sloped inner surface 138 may be disposed about collet body 70 and held in place by uppermost end 140 of outer sleeve 120. An o-ring 137 may be used to urge elastomeric ring 136 outwardly into engagement with outer case 50. Sloped inner surface 138 will mate with a sloped surface 139 defined in the outer surface of collet body 70. Lower portion 124 of outer sleeve 120 has threads 141 at or near the lower end thereof on inner diameter 130.

Orienting device 118 further comprises an inner sleeve 146 which may be referred to as orienting sleeve 146. Inner sleeve 146 has a stepped outer surface 148. Thus, inner sleeve 146 may comprise upper portion 150 with first outer diameter 151, and a second or lower portion 152 with second outer diameter 153 stepped radially outwardly from first outer diameter 151. Upper portion 150 is preferably received in upper portion 122 while lower portion 152 is preferably closely received in lower portion 124 of outer sleeve 120. Port 154 is a pressure equalization port and extends from an uppermost end 156 of orienting sleeve 146 downwardly through first portion 150 thereof. Orienting sleeve 146 has a slot or receptacle 158 with longitudinal axis, or center 159 defined in upper portion 150 thereof. Set screws 160 extend through outer sleeve 120 and preferably through the lower portion 124 thereof and engage the lower portion 152 of orienting sleeve 146 to affix orienting sleeve 146 to outer sleeve 120. Thus, rotational movement of outer sleeve 120 will cause rotational movement of orienting sleeve 146. Likewise, because outer sleeve 120 is threadedly connected to collet 68, the rotation of collet 68 will cause the rotation of outer sleeve 120. Rotation of outer case 50 will cause rotation of collet 68.

Orienting device 118 further includes a piston 166. Piston 166 is closely received in collet body 70, preferably in the lower portion thereof, and is likewise closely and slidably received in orienting sleeve 146. As is shown in the figures, piston 166 is received in the first portion 150 of orienting sleeve 146. Piston 166 has inner surface 168 defining a central flow passage 170 therethrough. A plurality of radial flow ports 172 are defined through a wall 173 of piston 166. Piston 166 has outer surface 174 defining a first outer diameter 176 and a second outer diameter 178 thereon. Radial ports 172 preferably are disposed through wall 173 at first diameter 176 and will communicate central flow passage 170 with an annulus 179 defined by and between piston 166 and orienting sleeve 146. Inner surface 168 of piston 166 defines first inner diameter 180 and a second larger inner diameter 182.

A groove which may be referred to as a peripheral or circumferential groove 184 is defined in outer surface 174 of piston 166. A gravity ball 186 is disposed in groove 184 and as shown in FIG. 3 is trapped therein by outer sleeve 120. As will be explained in more detail hereinbelow, uppermost end 156 of orienting sleeve 146 will act as a stop for gravity ball 186. In a deviated well, the gravity ball 186 will rest on the low side of orienting sub 18 relative to wellbore 14. Thus, gravity ball 186 will be positioned directly opposite the high side of the wellbore 14. While gravity ball 186 is described herein as a ball heavy enough to fall to a low side of a wellbore, it is understood that the gravity ball may be weighted so that it floats on fluid in the well and will migrate to the high side of the well.

Annulus or annular space 179 comprises first and second portions 188 and 189. Second portion 189 of annulus 179 is smaller than first portion 188.

A rupture disc assembly 190 is threaded or otherwise connected in piston 166 and preferably in first inner diameter 180 thereof. Rupture disc assembly 190 includes a rupture disc housing 192 with a rupture disc 194 attached thereto by means known in the art. An anti-rotation ring 196 with a central opening 197 therethrough may be connected in second inner diameter 182.

A bottom cap 200 is connected to and is preferably threadedly connected to an outer sleeve 120. Bottom cap 200 has a central opening 202 therethrough with first, second and third inner diameters 204, 206 and 208. An upward facing shoulder 210 is defined by and between second and third inner diameters 206 and 208. A biasing member 212 which may be a spring 212 having first and second or upper and lower ends 214 and 216, respectively, is housed in opening 202 in bottom cap 200. First end 214 engages rupture disc housing 192 and second end 216 engages shoulder 210. Spring 212 applies an upwardly directed force to rupture disc housing 192 and thus applies an upwardly directed force to piston 166. Bottom cap 200 has anti-rotation rings 218 and 220 connected thereto.

The method of assembly of orienting sub 18 may be as follows. Prior to connecting outer case 50 into casing 16, collet 68 is inserted through the upper end thereof. Collet fingers 72 may be squeezed inwardly. When thread profile 74 mates with thread profile 60 on outer case 50, collet fingers 72 will deflect radially outwardly slightly and will be rotationally engaged with outer case 50. Releasing sleeve 86 will have been previously connected to collet 68. Cap 94 may be threaded onto releasing sleeve 86 and wedge 100 may be placed between cap 94 and collet fingers 72 prior to inserting collet 68 into outer case 50. Retaining ring 104 can then be threaded onto cap 94 so that collet 68 is retained in outer case 50. Plug seat 110 may then be threaded onto cap 94. Outer case 50 may then be threaded at its upper end into casing 16.

Prior to connecting the lower end of outer case 50 to casing 16, the remaining pieces of orienting sub 18 are inserted. Outer sleeve 120 of orienting device 118 is threadedly connected to collet body 70. Piston 166 is inserted along with gravity ball 186. Orienting sleeve 146 is inserted into outer sleeve 120 and is positioned so that central axis 159 is 180 degrees from longitudinal central axis 159 of the structure to be properly oriented in the well, in this case window 12. Once orienting sleeve 146 is properly positioned such that receptacle 158 is oriented with respect to window 12, set screws 160 are inserted to affix orienting sleeve 146 to outer sleeve 120. Bottom cap 200 is threadedly connected to outer housing 120 along with spring 212.

Once bottom cap 200 is connected, the lower end of outer case 50 is connected in casing 16 and the casing may be lowered into a well. Casing 16 may be lowered into the well until window 12 or other structure to be oriented is at a desired depth or distance from the surface. Orienting sub 18 will be as shown in FIG. 3 as it is lowered into the wellbore 14. In FIG. 3 piston 166 is in a first position which defines a first flow path through the orienting sub 18. The first flow path passes through releasing sleeve 86, piston 166 through ports 172 and into the annulus 179. Fluid can flow through annulus 179 around a lower end of piston 166 and into and through opening 202 in bottom cap 200. Fluid can then continue to flow downwardly through casing 16.

Figure 4:
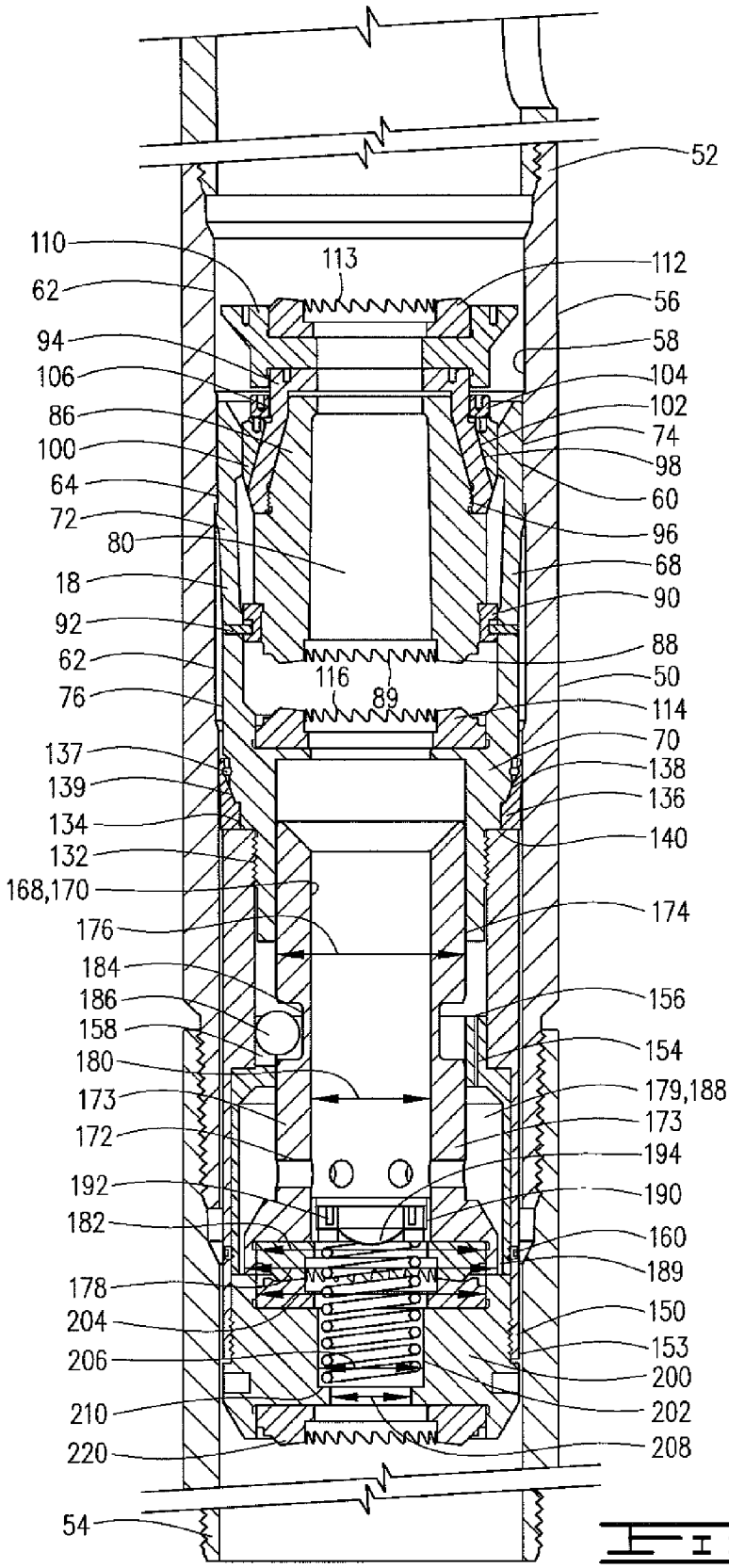
FIG. 4 is a cross-sectional view of the orienting sub rotated to a desired orientation.

When it is determined that structure 12 is the desired distance from the surface, it must be determined if window 12 is at the proper orientation, which in this example is facing directly upwardly. To determine if window 12 is at the proper orientation, fluid is flowed at a predetermined known constant rate through casing 16 and orienting sub 18. It is understood that window 12 will be covered in a manner known in the art during this process. As fluid is flowed pressure is measured at a surface pump or other means known in the art. A pressure indication of a first magnitude will result from the flow rate when piston 166 is in the first position as shown in FIG. 3. One method for orienting window 12 is to cease flow and to rotate casing 16. Rotation of easing 16 will rotate window 12 and will likewise rotate orienting sub 18. As explained herein, rotation will ultimately cause the rotation of orienting sleeve 146 which has receiving slot or receptacle 158 therein. After a desired amount of rotation fluid flow can be restarted through casing 16 to determine if the pressure indication changes. If a change is recognized, the process is repeated. In the given example, window 12 is properly oriented when receptacle 158 is located at a lowermost side of orienting sub 18 as shown in FIG. 4. In this position, gravity ball 186 will be received in receptacle 158 upon the application of fluid pressure. When rotated to the proper orientation, fluid flow through casing 16 will urge piston 166 downwardly since the uppermost end of orienting sleeve 146 no longer acts as a stop to prevent gravity ball 186 and piston 166 from moving downwardly. A pressure increase or pressure spike will be noted since when piston 166 moves to the second position shown in FIG. 4, a second more restricted flow path is defined. Fluid will flow through piston 166 and out flow ports 172 as described but as shown in FIG. 4, piston 166 will engage bottom cap 200. Thus, in the second position in the piston 166, a second more restrictive flow path is defined. Preferably, circulation will be permitted such that the second flow path will be restricted to create a pressure increase sufficient to indicate the orienting sub 18, and thus window 12 is at the proper orientation. For example, flow may be allowed to pass therethrough through small openings (not shown) or around bottom cap 200. Additionally, piston 166 may not create a hydraulic seal with bottom cap 200, or may be slightly spaced therefrom. In any event, the second flow path that occurs when piston 166 is in the second position is a more restricted flow path such that a pressure increase will be seen indicating that receptacle 158 is at the position which indicates the proper orientation of window 12.

Figure 2:
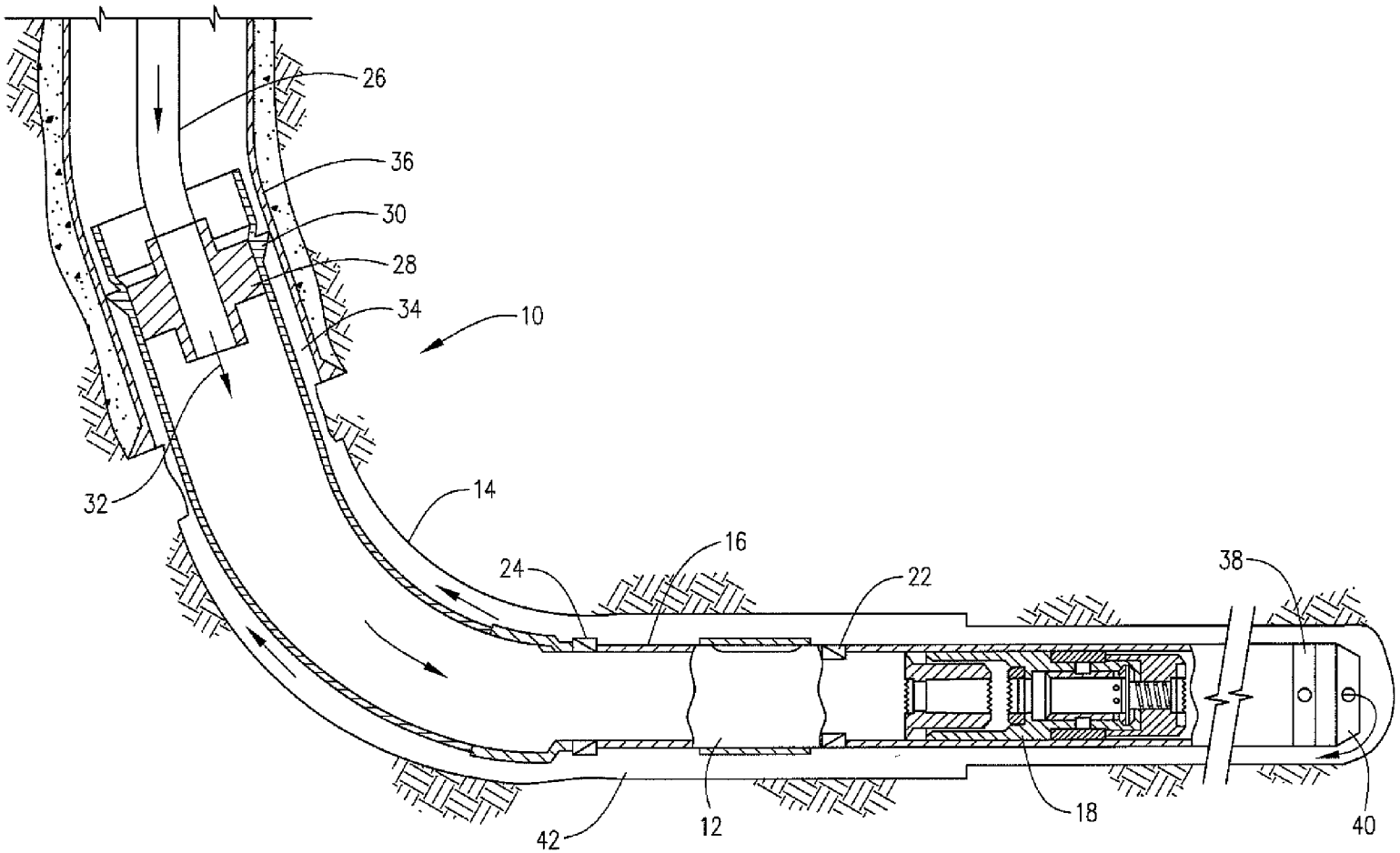
FIG. 2 shows the casing after it has been rotated so that a structure therein is at a desired orientation.
Figure 5:
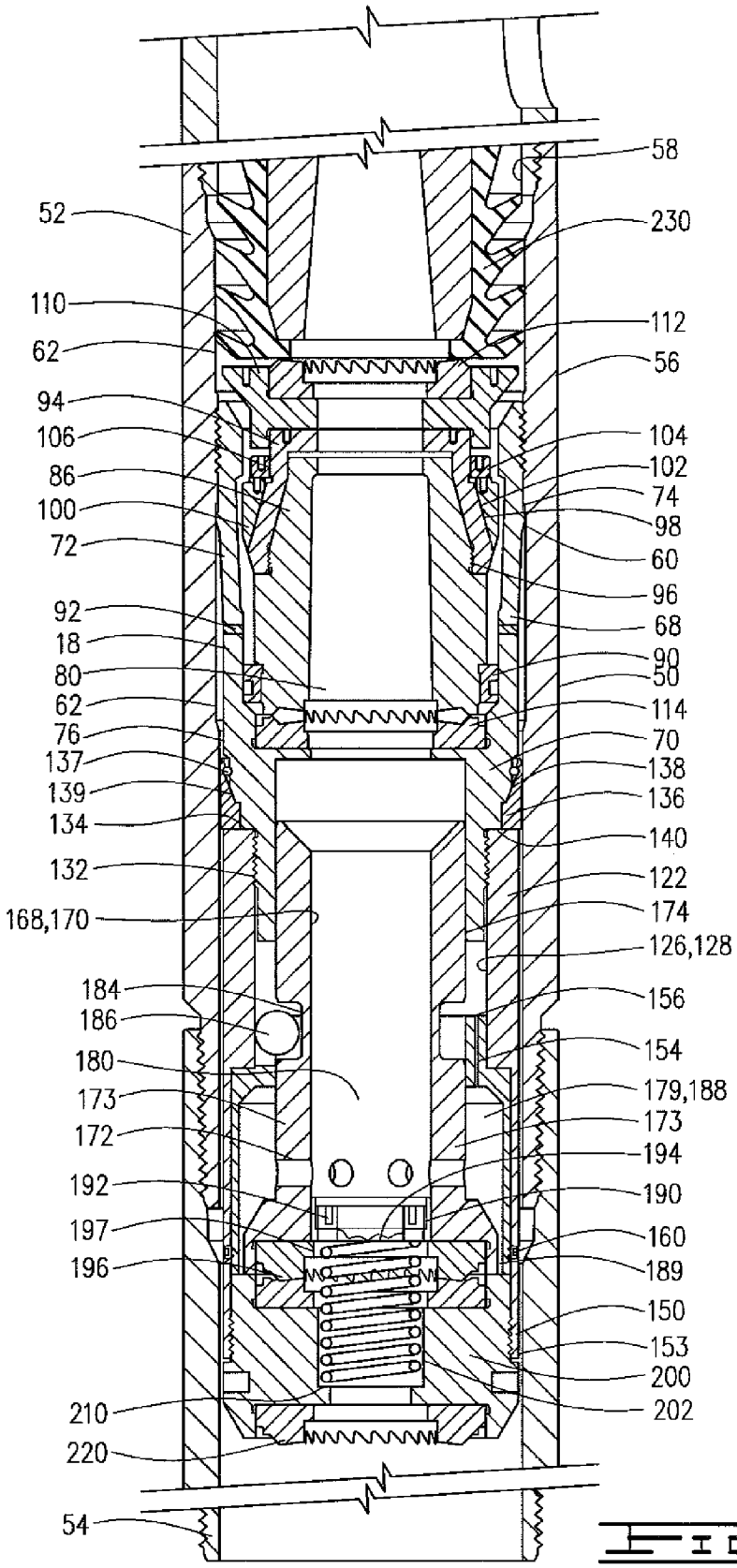
FIG. 5 is a view similar to FIG. 4 and shows the orienting sub after the releasing sleeve has been detached from a collet in the orienting sub.
Figure 8:
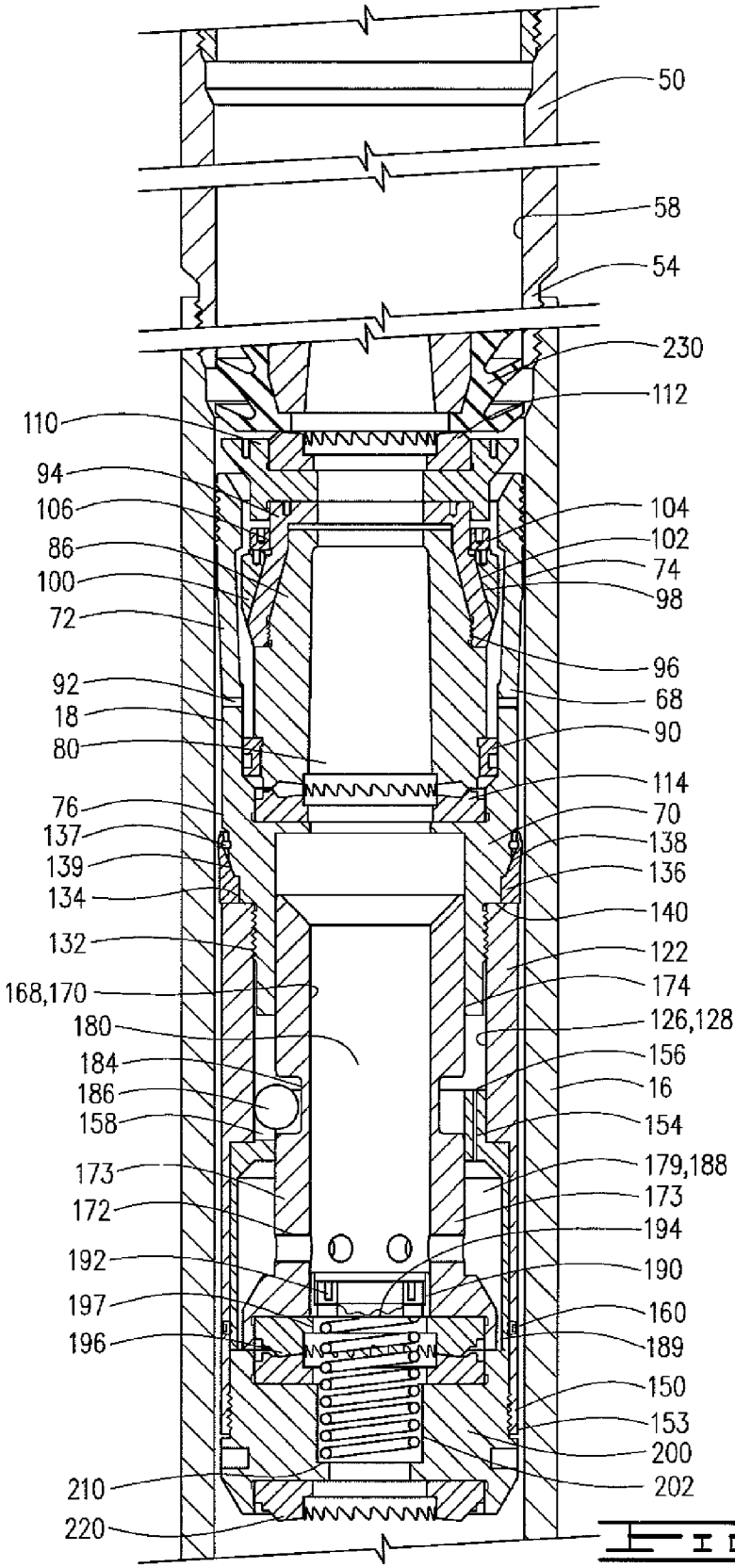
Figure 7:
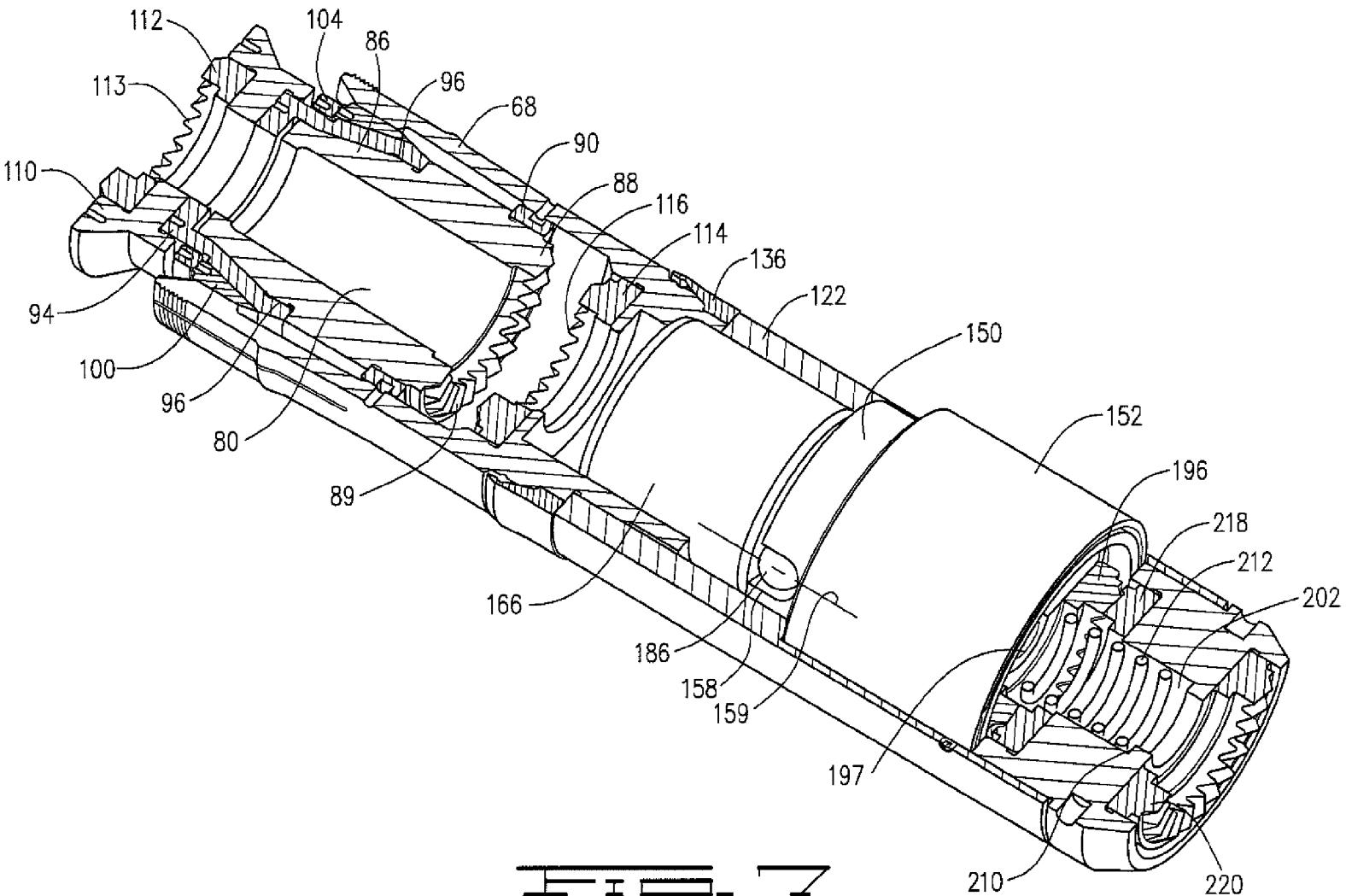
FIG. 7 is a perspective cross-sectional view of the orienting sub and shows a gravity ball received in a receptacle.

Once the window 12 is at the proper orientation fluid flow will be increased to create a pressure sufficient to rupture disc 194. Fluid may then be flowed therethrough and a bottom cementing plug 230 as shown in FIG. 5 can be pumped through casing 16 ahead of a column of cement. Once bottom cementing plug 230 engages plug seat 110, fluid flow can be increased to an amount sufficient to break shear pins 92 which will cause releasing sleeve 86 to move downwardly allowing collet fingers 72 to move radially inwardly thus releasing orienting sub 18. FIG. 5 shows orienting sub 18 after releasing sleeve 86 is detached, and FIG. 6 shows orienting sub 18 after it has passed through outer case 50 into the portion of casing 16 therebelow. Orienting sub 18 will pass downwardly through casing 16 to engage the float shoes or float collars shown in FIGS. 1 and 2. Pressure is then further increased to rupture a membrane in bottom cementing plug 230 so that cementing may occur therethrough. Cement will pass through orienting sub 18 and through float shoes or collars, and once a sufficient amount of cement has been displaced, a top cementing plug can be displaced into casing 16. The top cementing plug may be displaced with a fluid known in the art. Cement will pass through the unrestricted bore of orienting sub 18 so that cementing occurs in the ordinary course with no restrictions in the cement flow path. Once upper casing 16 is cemented in place, drilling through window 12 can proceed in a manner known in the art.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. An apparatus for indicating the orientation of a structure in a deviated wellbore, the apparatus comprising:

an orienting sub releasably connected in an outer case, the orienting sub having a preselected orientation relative to the structure, wherein a change in fluid pressure of a predetermined magnitude at a selected fluid flow rate through the orienting sub indicates the structure is at a desired orientation in the well, wherein the orienting sub is configured to release from the outer case while positioned in the well.

2. The apparatus of claim 1, the orienting sub comprising:

a collet rotatable with the outer case; and an orienting device connected to the collet and rotatable therewith.

3. The apparatus of claim 2, the orienting device comprising:

an outer sleeve connected to the collet and rotatable therewith; and an inner sleeve rotatable with the outer sleeve, the orientation of the inner sleeve being fixed relative to the structure, wherein the pressure change occurs when the inner sleeve is rotated to a predetermined orientation in the well.

4. The apparatus of claim 2, the orienting device comprising a piston movable axially relative to the inner sleeve wherein the piston is in a first position to define a first flow path through the apparatus when the structure is not at the desired orientation, and is in a second position to define a second more restrictive flow path when the structure is at the desired orientation so that pressure will increase when the structure is at the desired orientation.

5. The apparatus of claim 4, further comprising a gravity ball positioned in a groove defined in an outer surface of the piston, the inner sleeve having a receptacle for receiving the gravity ball, the structure being at the desired orientation in the well when the receptacle is aligned with the gravity ball.

6. The apparatus of claim 5, wherein the piston moves from the first to the second position at the constant flow rate when the receptacle is aligned with the gravity ball.

7. An apparatus for indicating the orientation of a structure in a casing lowered into a well, the apparatus comprising:

an outer case connectable in the casing;

a housing releasably attached in the outer case;

a releasing sleeve detachably connected to the housing;

a piston movable in the housing between first and second positions in the housing, wherein in the first position a first flow path through the housing is defined and in the second position a second restricted flow path through the housing is defined so that fluid pressure increases when fluid flows at a constant rate through the housing when the piston is in the second position, and wherein the increase in fluid pressure indicates the structure is at the desired orientation in the well, wherein the housing is configured to release from the outer case while in the well.

8. The apparatus of claim 7 further comprising a stop for preventing the piston from moving from the first to the second position until the structure is at the desired orientation in the well.

9. The apparatus of claim 8, further comprising:

a gravity ball positioned in a groove in an outer surface of the piston, the gravity ball being located at a lowermost position in the housing when the casing is in a deviated well; and a sleeve disposed in the housing, the stop comprising an upper end of the sleeve, wherein the sleeve defines a receptacle for receiving the gravity ball.

10. The apparatus of claim 8, wherein the piston defines an axial flow passage therethrough and a plurality of ports through a wall thereof, and wherein the axial flow passage and the flow ports define a portion of both of the first and second flow paths.

11. The apparatus of claim 7 comprising:

a collet releasably attached to the outer case; and an outer sleeve connected to the collet at a lower end of the collet, the releasing sleeve being detachably connected to the collet, wherein the outer sleeve and the piston comprise a portion of an orienting device, the orienting device further comprising an orienting sleeve fixed to the outer sleeve, wherein the orienting sleeve prevents the piston from moving to the second position until the casing is rotated such that the structure is at the desired orientation.

12. The apparatus of claim 11, further comprising a gravity ball disposed in a peripheral groove in the piston, the orienting device comprising a receptacle for receiving the gravity ball when the structure is at the desired orientation.

13. The apparatus of claim 11, wherein a center of the receptacle is positioned 180° from a center line of the structure.

14. A method of orienting a structure in a pipe string in a deviated well, the method comprising:

positioning an orientation device at a predetermined position relative to the structure;

connecting the orienting device in the pipe string at the predetermined position;

lowering the pipe string in the deviated well to a desired depth;

flowing fluid at a selected flow rate through the orienting device;

observing a pressure reading resulting from the flow through the orienting device;

rotating the pipe string in the well until the observed pressure reading changes to indicate the device is at a known orientation in the deviated well, wherein the structure is at the desired orientation when the orienting device is at the known orientation; and releasing, in the well, the orienting device from the pipe string after the structure is at the desired orientation.

15. The method of claim 14 comprising:

stopping the fluid flow prior to rotating the pipe string in the well;

restarting the fluid flow after the rotating step;

performing the observing step; and repeating the stopping, rotating, restarting and performing steps until the pressure reading reflects the known orientation of the orienting device.

16. The method of claim 14, wherein the observed pressure is a first pressure when the structure is not properly oriented and is a second, increased pressure when the structure is at the proper orientation in the well.

17. The method of claim 14, wherein the pipe string is a casing, the method further comprising flowing cement through the casing and into an annulus between the casing and the wellbore after the orienting device is released.

18. The method of claim 17, the releasing step comprising displacing a plug into the casing and increasing pressure in the casing to release the orienting device from the casing.

19. The method of claim 18, wherein the orienting device is releasably connected in an outer case, the outer case being connected to and forming a part of the casing.

20. A method of orienting a structure in a pipe string in a deviated well, the method comprising:

positioning an orientation device at a predetermined position relative to the structure;

connecting the orienting device in the pipe string at the predetermined position;

lowering the pipe string in the deviated well to a desired depth;

flowing fluid at a selected flow rate through the orienting device;

observing a pressure reading resulting from the flow through the orienting device;

rotating the pipe string in the well until the observed pressure reading changes to indicate the device is at a known orientation in the deviated well, wherein the structure is at the desired orientation when the orienting device is at the known orientation;

releasing the orienting device from the pipe string after the structure is at the desired orientation, wherein the pipe string is a casing; and flowing cement through the casing and into an annulus between the casing and the wellbore after the orienting device is released.

21. The method of claim 20, the releasing step comprising displacing a plug into the casing and increasing pressure in the casing to release the orienting device from the casing.

22. The method of claim 21, wherein the orienting device is releasably connected in an outer case, the outer case being connected to and forming a part of the casing.

* * * * *